US005136336A

United States Patent [19]

Dastin et al.

[11] Patent Number: 5,136,336

[45] Date of Patent: Aug. 4, 1992

[54] TRANSFER MECHANISM FOR A SHEET TRANSPORT SYSTEM

[75] Inventors: Richard M. Dastin, Fairport; John E. Kosko, Victor; Roger M. Swanson, Fairport, all of N.Y.

[73] Assignee: Xerox Corporation, Stamford, Conn.

[21] Appl. No.: 729,108

[22] Filed: Jul. 12, 1991

[51] Int. Cl.[5] ..... G03G 15/16

[52] U.S. Cl. ..... 355/274; 355/219; 355/326

[58] Field of Search ..... 355/271, 274, 272, 275, 355/281, 315, 326, 327, 219; 271/277, 275, 204, 205

[56] References Cited

U.S. PATENT DOCUMENTS

| | | | |
|---|---|---|---|
| 4,367,032 | 1/1983 | Sakamoto et al. | 355/315 |
| 4,849,795 | 7/1989 | Spehrley, Jr. et al. | 355/271 X |
| 4,978,118 | 8/1990 | Kasahara | 271/275 |

*Primary Examiner*—A. T. Grimley
*Assistant Examiner*—Shuk Y. Lee
*Attorney, Agent, or Firm*—Paul J. Maginot

[57] ABSTRACT

An apparatus is described which advances a sheet in a predetermined path through a transfer zone and into registration with information developed on a moving member. The apparatus charges the sheet to transfer the information from the moving member to the sheet. The apparatus includes a mechanism to maintain the charge on the sheet during advancement thereof.

17 Claims, 5 Drawing Sheets

TRANSFER MECHANISM FOR A SHEET TRANSPORT SYSTEM

This invention relates generall to an electrophotographic printing machine, and more particularly concerns a sheet transport for moving sheet in path to enable a toner image to be transferred thereto. The invention also particularly concerns a sheet transport for moving a sheet in a recirculating path to enable successive toner images to be transferred thereto in superimposed registration with one another.

The marking engine of an electronic reprographic printing system is frequently an electrophotographic printing machine. In an electrophotographic printing machine, a photoconductive member is charged to a substantially uniform potential to sensitize the surface thereof. The charged portion of the phyotoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which si esubsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentary colored toner. Each single color toner image is transferred to the copy sheet in superimposed registration with the toner image. This creates a multi-layered toner image on the copy sheet. Thereafter, the multi-layered toner image is permanently affixed to the copy sheet creating a color copy. the developer material may be a liquid or a powder material.

In the process of black and white printing, the copy sheet is advanced from an input tray through a path internal the electrophotographic printing machine including a transfer station where a toner image is transferred to the copy sheet and a fuser station where the toner image is permanently affixed to the copy sheet. Finally, the copy sheet having the fused toner image thereon is transported to an output catch tray for subsequent removal therefrom by the machine operator. In the process of multi-color printing, the copysheet moves from an input tray through a recirculating path internal the printing machine including a transfer station where a plurality of differently colored toner images are transferred to the copy sheet in registration with one another. Thereafter, the sheet is transported to a fuser station where the toner images are permanently affixed to the copy sheet. The copy sheet, with a fused multi-color image thereon, is then transported to an output catch tray for removal by a machine operator.

In each of the above processes of printing, a sheet gripper which is secured to a transport receives and grips the copy sheet at the leading edge thereof. The sheet gripper then transports the sheet though the transfer station a number of times. Each time the sheet is transport therethrough, the sheet is electrically charged so as to facilitate transfer of the developed toner image from the moving member to the sheet.

A problem which may occur, especially in high relative humidity conditions, is dissipation of the charge on the sheet subsequent to charging thereof and prior to transfer of the developed toner image from the moving member to the sheet. The above occurs since the sheet is physically gripped by the sheet gripper and the sheet gripper is coupled to electrical ground. The leading edge portion of the sheet near the sheet gripper is especially susceptible to having the charge thereon dissipated since such portion is physically adjacent the electrically grounded sheet gripper. Dissipation of the charge on portions of the sheet, as discussed above, severely inhibits the transfer of the developed toner image to the sheet thereby causing informational deletions to occur on the output copy sheet. It would be desirable to provide a sheet transport system which has a sheet gripper secured thereto that transports a sheet through the transfer station while allowing the sheet to better maintain the charge thereon so as to improve transfer of the developed toner image from the moving member to the sheet.

The following disclosures may be relevant to various aspects of the present invention:

U.S. Pat. No. -4,367,032
Patentee: Sakamoto et al.
Issued: Jan. 4, 1983
Device: Sheet Transport System
Product Used Within: Xerographic Machine Model Number 1065
Company: Xerox Corporation The relevant portions of the foregoing disclosures may be briefly summarized as follows:

U.S. Pat. No. -4,367,032 discloses an electrostatic copying apparatus wherein a toner image of an original document is formed on a photoconductive drum and transferred onto a copy sheet which is moved into contact with the drum by a corona charging unit which applies an electrostatic charge to the copy sheet causing the toner image to be transferred thereto. the copy sheet is separated from the drum by a conductive belt. The belt is initially grounded so that the leading edge of the copy sheet is attracted thereto by induced electrostatic charge. A voltage of the same polarity as the transfer charge is then applied to the belt to prevent transfer of the toner image back to the drum. The above reference also states that a constant voltage element such as a zener diode and a resistor may be connected between the conductive member and ground in order to prevent the toner image for being smeared or transferred back to the drum.

A sheet transport system is used in a xerographic printing machine sold by the Xerox Corporation of Stamford, Conn., as model number 1065. The sheet transport system includes an inlet baffle which is used to guide a sheet as the sheet is initially acquired by the sheet transport system. A resistor is interposed between the inlet baffle and electrical ground.

In accordance with one aspect of the present invention, there is provided an apparatus for advancing a sheet in a predetermined path through a transfer zone and into registration with information developed on a moving member. The apparatus comprises means for advancing the sheet through the transfer zone and means for charging the sheet to transfer the information from the moving member to the sheet. The apparatus further comprises means, coupled to the advancing means, for maintaining the charge on the sheet while the sheet is being advanced by the advancing means.

Pursuant to another aspect of the present invention, there is provided a printing machine of the type having a toner image developed on a moving member with a sheet being advanced in a predetermined path through a transfer zone and into registration with the toner image. The printing machine comprises means for advancing the sheet through the transfer zone and meands for charging the sheet to transfer the toner image from the moving member to the sheet. The printing machine further comprises means for maintaining the electrostatic charge on the sheet while the sheet is being advanced by the advancing means.

Other features of the present invention will become apparent as the following description proceeds and upon reference to the drawings, in which.

Figure 1:
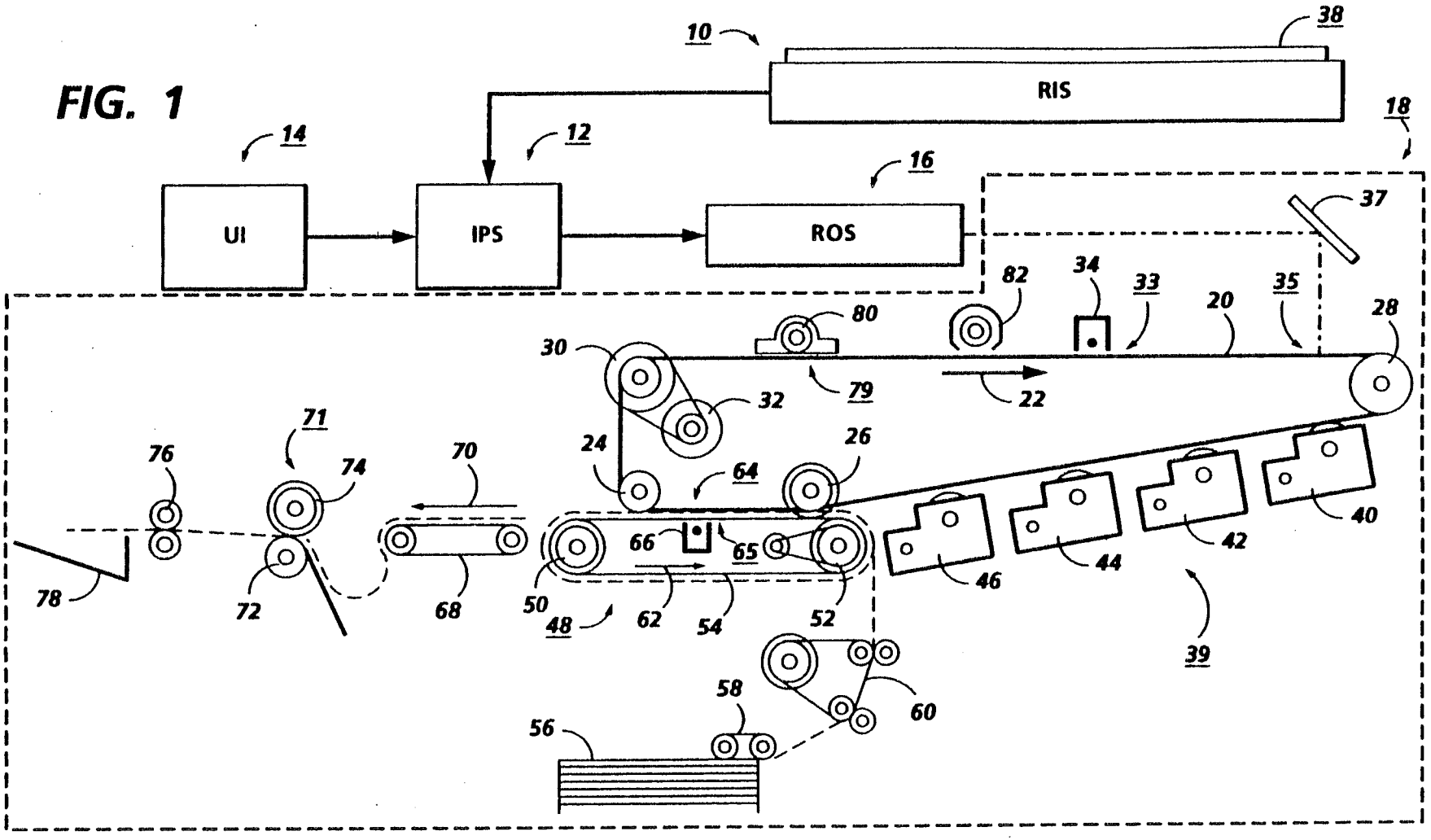
FIG. 1 is a schematic elevational view showing an electrophotographic printing machine incorporating the features of the present invention therein.
Figure 7:
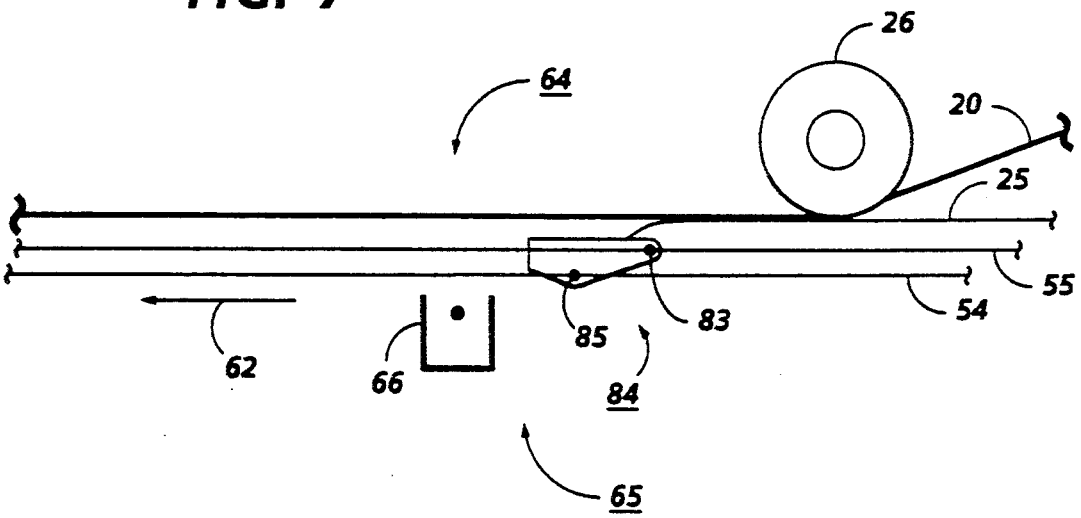
Figure 8:
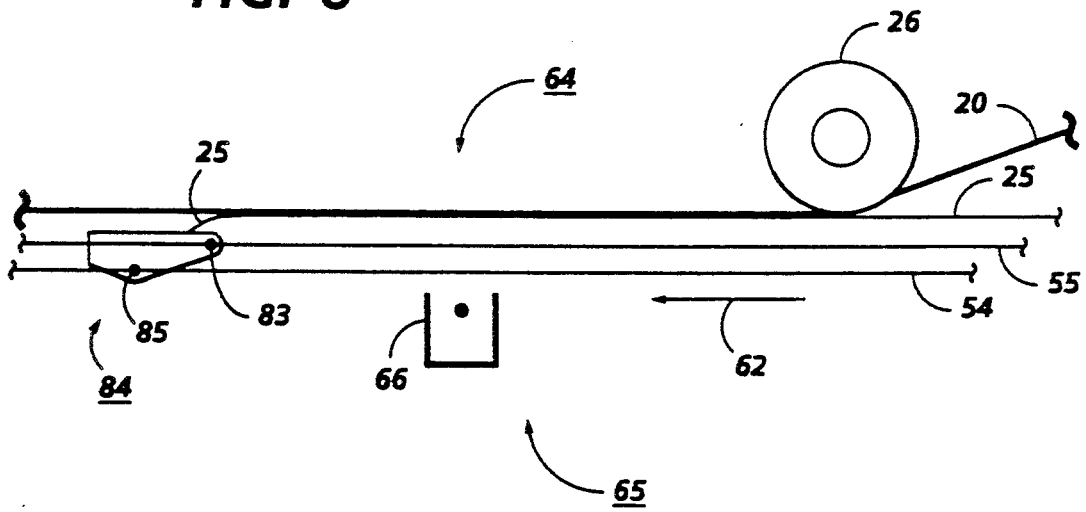

FIG. 7 is a schematic elevational view of the sheet gripper of the sheet transport system used in the electrophotographic printing machine of FIG. 1 with the sheet gripper shown located at a position within the transfer zone proir to passing over the corona generating device; and FIG. 8 is a schematic elevational view of the sheet gripper of the sheet transport system used in the electrophotographic printing machine of FIG. 1 with the sheet gripper shown located at a position within the transfer zone after the sheet gripper and the leading edge portion of the sheet have passed over the corona generating device.

While the present invention will hereinafter be described in connected with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control elecronics which prepare and manage the image data flow to a raster output scanner (ROS), indicated generally by the reference nemeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror 37, the charged portion of a photoconductive belt 20 of a printer or making engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then foused to the copy sheet forming a color copy.

With continued reference to FIG. 1, printer or making engine 18 is an electrophotographic printing machine. Photoconductive belt 20 of marking engine 18 is preferably made from a pholychromatic photoconductive material. the photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charge photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having a multi-colored original document 38 positioned thereat. The modulated light beam illuminates the charged portion of photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in art as "magnetic brush development units." Typically, a magnetic brush development system employs a magnetizable developer material including magnetic carrier granules having toner particles adhering triboelectrically thereto. The developer material is continually brought through a directional flux field to form a bush of developer material. The developer material is constantly moving so as to continually provide the bush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (see FIGS. 3–6), extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recirculating path. The leading edge of sheet 25 is secured releasably by the sheet gripper. Furter details of the sheet transport system will be discussed hereinafter with reference of FIGS. 2–8. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one other. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
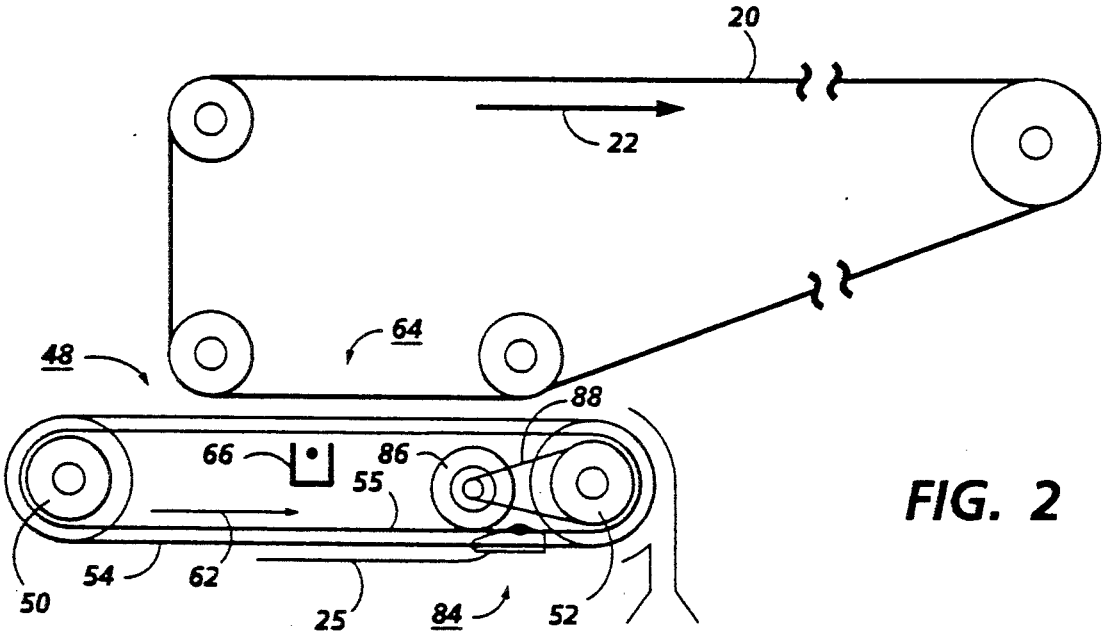
FIG. 2 is a schematic elevational view showing further details of the sheet transport system used in the electrophotographic printing machine of FIG. 1.
Figure 3:
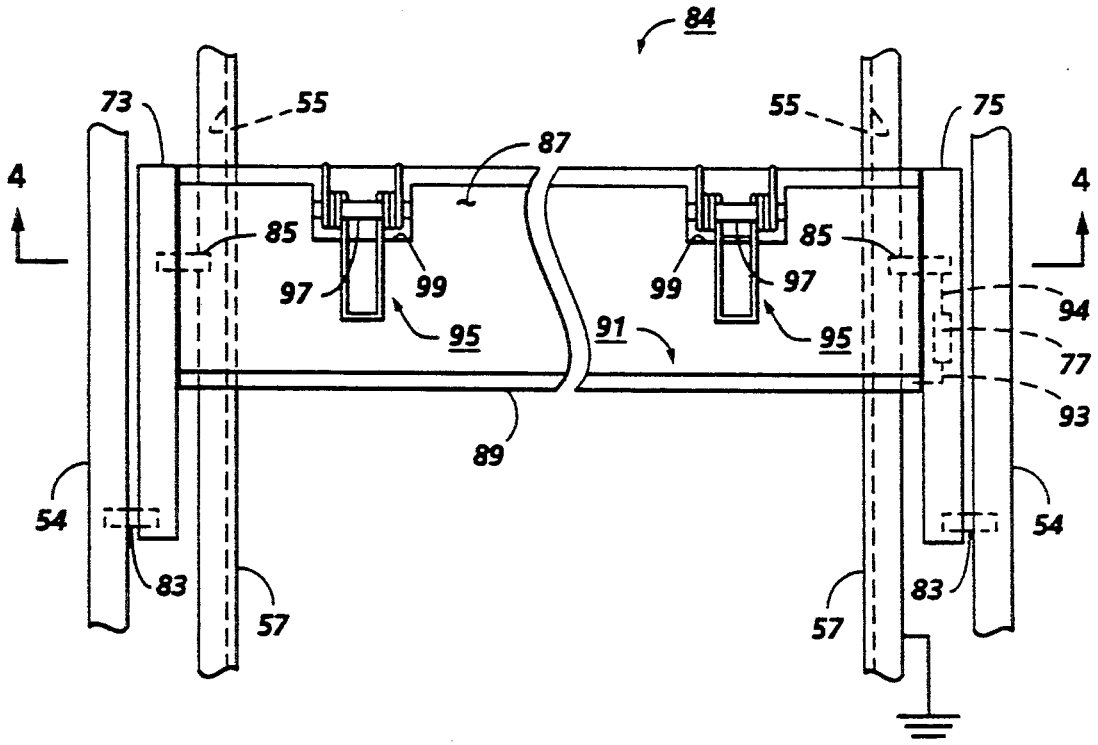
FIG. 3 is a schematic planar view showing the sheet gripper of the sheet transport system used in the electrophotographic printing machine of FIG. 1.
Figure 4:
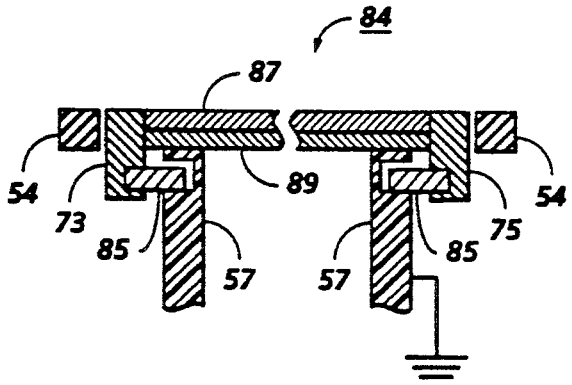
FIG. 4 is a sectional elevational view taken in the direction of arrows 4—4 in FIG. 3 of the opposed side marginal regions of the sheet gripper.

FIG. 2 shows sheet gripper 84 of sheet transport 48 transporting sheet 25 in the direction of arrow 62 in a recirculating path of movement. FIG. 3 shows sheet gripper 84 suspended between two spaced apart timing belt 54. FIG. 4 shows a sectional elevational view of the opposed side marginal regions of sheet gripper 84. Referring to FIGS. 2–4, timing belts 54 are mounted on rollers 50 and 52. Belts 54 define a continuous path of movement of sheet gripper 84. A motor 86 is coupled to roller 52 by a drive belt 88. Sheet gripper 84 includes a pair of guide members 85. The guide members are comprised of an electrically conductive material. A pair of spaced apart and continuous tracks 55 are respectively positioned substantially adjacent belts 54. Tracks 55 are respectively defined by a pair of track supports 57. Track supports 57 are comprised of an electrically conductive material. One of the track supports is connected to electrical ground as shown in FIGS. 3–4. Each of guide members 85 are slidably positioned within a respective track 55. As a result, an electrical connected is established between the electrically grounded track support and its respective guide member 85. Sheet gripper 84 further includes an upper gripping portion 87 and a lower gripping portion 89 which are biased toward each other by a plurality of springs, each being generally indicated by the reference numeral 95 (see FIGS. 3–6). Gripping portions 87 and 89 are comprised of an electrically conductive material. Gripping portions 87 and 89 are respectfully connected to a pair of gripper supports 73 and 75 as shown in FIGS. 3–4. Gripper supports 73 and 75 are comprised of an electrically insulating material. A plurality of securing pins 97 are respectively positioned within apertures 99 of upper gripping portion 87 and secured thereto to hold springs 95 in place so as to bias upper gripping portion 87 toward lower gripping portion 89. Springs 95 are comprised of an electrically conductive material. Sheet gripper 84 further includes a resistor 77 having a pair of leads 93 and 94 as shown in FIG. 3. Lead 93 is electrically connected to lower gripping portion 89 while lead 94 is electrically connected to the electrically grounded guide member 85 (see FIG. 3). The value of resistor 77 is preferably about 60 megohms.

Figure 5:
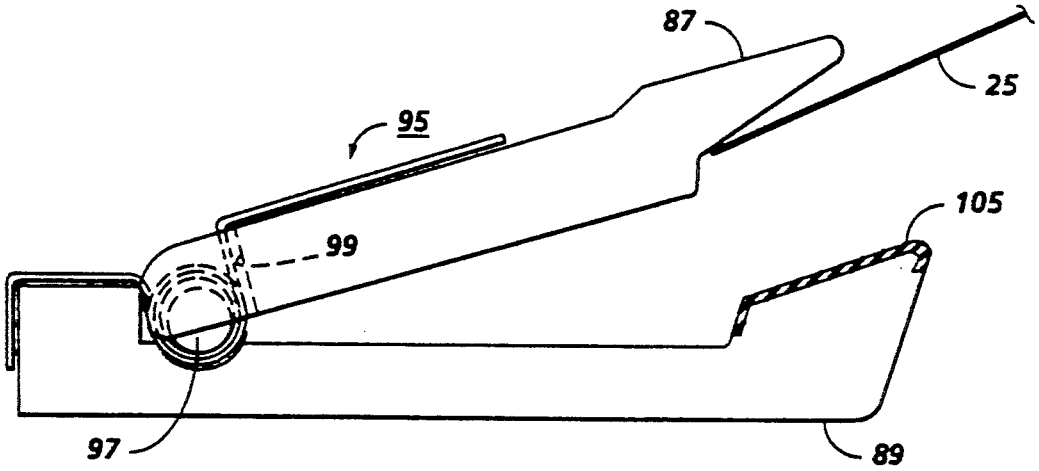
FIG. 5 is a schematic elevational view of the gripping portions of the sheet gripper of the sheet transport system used in the electrophotographic printing machine of FIG. 1 with the sheet gripper in the open position and further showing a sheet within the gripping nip.
Figure 6:
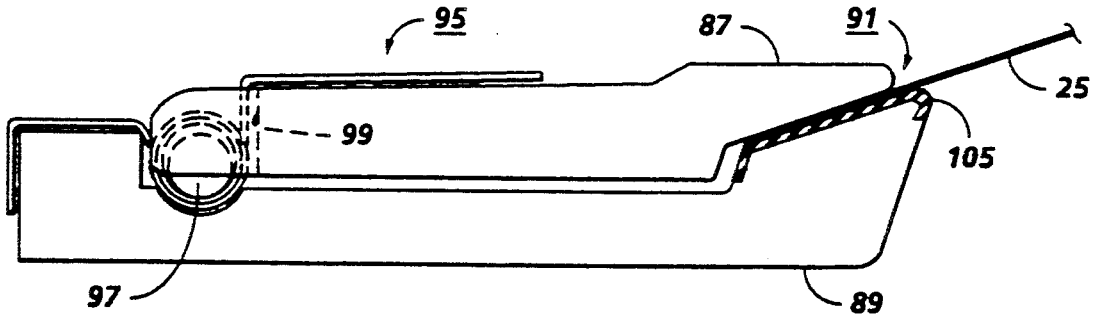
FIG. 6 is a schematic elevational view of the gripping portions of the sheet gripper of the sheet transport system used in the electrophotographic printing machine of FIG. 1 with the sheet gripper in the closed position and further showing a sheet ssecured within the sheet gripper.

The sheet gripper further further includes a pair of cam followers (not shown) which are attached to the opposed side marginal regions of upper gripping portion 87 and function with a pair of cams (not shown) to open and close the gripping portions at predetermined intervals. FIG. 5 shows the orientation of upper gripping portion 87 relative to lower gripping portion 89 when the cam followers are actuated to overcome the bias of springs 95. FIG. 6 shows the orientation of upper gripping portion 87 relative to lower gripping portion 89 when the cam followers are moved to a non-actuated position. The cam follower is in this position when they are not in contact with the cams. In the closed portion, upper gripping portion 87 cooperates with lower gripping portion 89 to grasp and securely hold the leading edge of sheet 25. The area at which the gripping portions 87 and 89 grasp sheet 25 defines a gripping nip, generally indicated by the reference numeral 91 (see FIGS. 3 and 6). Positioned upon lower gripping portion 89, near gripping nip 91, is a silicone rubber coating 105 (see FIGS. 5 and 6). With coating 105 positioned as above, the frictional grip of sheet 25 between the gripping portions is increased. Belts 54 are respectively connected to gripper supports 73 and 75 by a pair of pins 83. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the gripper and the belts are connected.

FIGS. 7–8 depict the movement of sheet gripper 84 as it transports sheet 25 within transfer zone 64. More specifically, FIG. 7 shows sheet gripper 84 transporting sheet 25 through transfer zone 64 wherein the sheet gripper is located at a position just prior to passing over corona generating device 66. As the sheet gripper and the leading edge portion of the sheet pass over the corona generating device, as shown in FIG. 8, the sheet is sprayed with ions by the corona generating device on its side opposite the photoconductive belt. Since a high resistance component, namely resistor 77, is electrically interposed between the upper gripping portion and electrical ground, the charge deposited on the sheet will substantially remain thereon. The machine components electrically interposed between the upper gripping portion and electrical ground includes electrically grounded track support 57 and its respective guide member 85, resistor 77, lower gripping portion 89 and spring 95. The sheet is not otherwise electrically coupled to any electrically grounded machine component within the transfer zone. The result of the above arrangement is the improvement of the transfer of the developed image from the photoconductive belt to the copy sheet, especially as the leading edge portion of the sheet.

In recapitulation, the sheet trasport system of the present invention includes a sheet gripper which has a resistor electrically interposed between the upper gripping portion and electrical ground which prevents the change deposited on the sheet within the transfer zone from migrating to electrical ground. As a result, improved transfer of the developed image from the photoconductive belt to the copy sheet is achieved.

It is, therefore, apparent that there has been provided in accordance with the present invention, a sheet transport system that fully satisfies the aims and advantages hereinafter set forth. While this invention has been described in conjuction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for advancing a sheet in a predetermined path through a transfer zone and into registration with information developed on a moving member, comprising:

means for advancing the sheet through the transfer zone, wherein said advancing means comprises a sheet gripper;

means for charging the sheet to transfer the information from the moving member to the sheet, wherein said charging means comprises means for depositing electrostatic charge on the sheet; and means, coupled to said advancing means, for maintaining the charge on the sheet while the sheet is being advanced by said advancing means, wherein said maintaining means comprises a resistor connected to said advancing means.

2. The apparatus of claim 1, wherein said sheet gripper comprises:

a gripper support;

a lower gripping portion attached to said gripper support;

an upper gripping portion attached to said gripper support;

a guide member attached to said gripper support; and a track member, adapted to allow said guide member to be positioned therein, for guiding said sheet gripper in the predetermined path.

3. The apparatus of claim 2, wherein said lower gripping portion, said upper gripping portion, said guide member and said track member are each comprised of an electrically conductive material.

4. The apparatus of claim 3, wherein said gripper support is comprised of an electrically insulating material.

5. The apparatus of claim 4, wherein said track member is connected to electrical ground.

6. The apparatus of claim 5, wherein said resistor is electrically interposed between said guide member and said lower gripping portion.

7. The apparatus of claim 6, wherein said lower gripping portion is electrically coupled to said upper gripping portion.

8. The apparatus of claim 7, wherein said maintaining means further comprises a spring, wherein said spring is comprised of an electrically conductive material.

9. The appratus of claim 8, wherein said spring is electrically interposed between said lower gripping portion and said upper gripping portion.

10. A printing machine of the type having a toner image developed on a moving member with a sheet being advanced in a predetermined path through a transfer zone and into registration with the toner image, comprising:

means for advancing the sheet through the transfer zone, wherein said advancing means comprises a sheet gripper;

means for charging the sheet to tranfer the toner image from the moving member to the sheet, wherein said charging means comprises means for depositing electrostatic charge on the sheet; and means for maintaining the electrostatic charge on the sheet while the sheet is being advanced by said advancing means, wherein said maintaining means comprises a resistor connected to said advancing means.

11. The printing machine of claim 10, wherein said sheet gripper comprises:

a gripper support;

a lower gripping portion attached to said gripper support;

an upper gripping portion attached to said gripper support;

a guide member attached to said gripper support; and a track member, adapted to allow said guide member to be positioned therein, for guiding said sheet gripper in the predetermined path.

12. The printing machine of said claim 11, wherein said lower gripping portion, said upper gripping portion, said guide member and said track member are each comprised of an electrically conductive material.

13. The printing machine of claim 12, wherein said gripper support is comprised of an electrically insulating material.

14. The printing machine of claim 13, wherein said track member is connected to electrical ground.

15. The printing machine of claim 14, wherein said resistor is electrically interposed between said guide member and said lower gripping portion.

16. The printing machine of claim 15, wherein said lower gripping portion is electrically coupled to said upper gripping portion.

17. The printing machine of claim 10, further comprising means for successively developing each of a plurality of toner images on the moving member, each having a different color, with the sheet being advanced into registration with each other of the plurality of toner images to form a multi-color image on the sheet.

* * * * *